US005212849A

United States Patent [19]

Aihara

[11] Patent Number: 5,212,849

[45] Date of Patent: May 25, 1993

[54] DEVICE FOR OPENING AND SHUTTING LID

[75] Inventor: Masahiro Aihara, Isehara, Japan

[73] Assignee: Kato Hatsujo Kaisha, Ltd., Kanagawa, Japan

[21] Appl. No.: 769,641

[22] Filed: Oct. 1, 1991

[30] Foreign Application Priority Data

Dec. 17, 1990 [JP] Japan ..... 2-411052

[51] Int. Cl.[5] ..... E05D 15/50

[52] U.S. Cl. ..... 16/232; 16/DIG. 23

[58] Field of Search ..... 16/231, 232, DIG. 23

[56] References Cited

U.S. PATENT DOCUMENTS

| | | | |
|---|---|---|---|
| 600,318 | 3/1898 | Pletcher | 16/232 |
| 2,349,486 | 5/1944 | Crosman . | |
| 3,628,217 | 12/1971 | Schaber et al. . | |
| 3,724,021 | 4/1973 | Lautenschlaeger, Jr. . | |
| 3,728,819 | 4/1973 | Goldbach et al. . | |
| 3,772,736 | 11/1973 | Hettich et al. . | |
| 3,977,043 | 8/1976 | Zernig . | |
| 3,978,549 | 9/1976 | Vitt . | |
| 4,126,964 | 11/1978 | Anderson . | |

FOREIGN PATENT DOCUMENTS 60-90042 6/1985 Japan .

*Primary Examiner*—Robert L. Spruill
*Assistant Examiner*—Carmine Cuda
*Attorney, Agent, or Firm*—Wenderoth, Lind & Ponack

[57] ABSTRACT

A device for opening and shutting in two directions a lid disposed rotatably on an opening of a box body includes a pair of rotary shafts and a pair of lock shafts severally disposed in opposite lateral parts of the opening of the box body, coil springs for interconnecting the rotary and lock shafts on the respective sides thereof and urging the lock shafts toward the corresponding rotary shafts, and an operating member for causing the lock shafts to be moved away from the corresponding rotary shafts against the resilient force of the springs. The opposite lateral parts of the lid have first engaging holes for engagement with the rotary shafts and second engaging holes for engagement with the lock shafts severally formed therein. The springs produce a pressing action to enable the lock shafts to be independently released from the corresponding second engaging holes.

2 Claims, 3 Drawing Sheets

DEVICE FOR OPENING AND SHUTTING LID

BACKGROUND OF THE INVENTION

1. Field of the Invention

The present invention relates to a device for opening and shutting in two directions a lid on an automobile console box or any other lid (inclusive of a door) rotatably disposed on an opening of a box body.

2. Description of the Prior Art

A device for opening and shutting the lid of an automobile console box in two directions has been already disclosed in Japanese Utility Model Public Disclosure No. 60-90042.

The conventional device, though not illustrated herein specifically, comprises supporting shafts of a circular cross section disposed one each along the opposite sides of the edge of an opening of a box body and bearing parts of a C-shaped cross section suitable for detachable insertion therein of the supporting shafts disposed integrally on the sides of the edge of a lid opposite the supporting shafts and enables the lid to shut the opening of the box body by having the bearing parts rotatably inserted around the corresponding supporting shafts. The release of the lid from the opening of the box body is attained by removing one of the bearing parts from the corresponding supporting shaft and rotating the lid about the other supporting shaft as a fulcrum or inversely by removing the other bearing part from the corresponding supporting shaft and, this time, rotating the lid about the other supporting shaft as a fulcrum. Owing to this construction, the opening of the box body can be exposed in two directions.

The conventional device allows the box body to be opened and shut selectively in two directions to suit the occasion and, therefore, offers very convenient use as compared with the classic switching device which allows the lid to be opened and shut only in one direction.

The conventional device described above indeed has the advantage of enabling the box body to be opened and shut in two directions simply by adopting an extremely simple construction having supporting shafts of a circular cross section disposed on the box body side and bearing parts of a C-shaped cross section disposed on the lid side. In the actual use of this switching device, however, the simplified construction ironically produces an evil effect of entailing the following problem.

In the conventional device, the side of the lid used for producing an opening or shutting motion requires the bearing part to be forcibly inserted around the supporting shaft or conversely requires the state of this insertion to be forcibly released, and the side of the lid used as the fulcrum for rotation suffers the bearing part to be immoderately rotated on the bearing part. Therefore, it has a serious problem that when the opening and shutting motions are frequently repeated, the C-shaped cross sections of the bearing parts are radially expanded or deformed and eventually prevented from allowing smooth opening and shutting motions or infallibly producing a perfectly open or shut state.

SUMMARY OF THE INVENTION

The main object of the present invention is to provide a device for opening and shutting a lid, which allows effective solution of the aforementioned problems suffered by the conventional device for opening and shutting a lid in two directions and, moreover, ensures infallible opening and shutting of the lid with a click owing to positive use of the resilient force of spring means.

To accomplish this object, according to the present invention there is provided a device for opening and shutting in two directions a lid rotatably disposed on an opening of a box body, which comprises a pair of rotary shafts and a pair of lock shafts severally disposed in opposite lateral parts of the opening of the box body, spring means interconnecting the rotary and lock shafts on the respective sides thereof and urging the lock shafts toward the corresponding rotary shafts, opposite lateral parts of the lid having first engaging holes for engagement with the pair of rotary shafts and second engaging holes for engagement with the pair of lock shafts severally formed therein, and an operating member for causing the lock shafts to be moved away from the corresponding rotary shaft against the resilient force of the spring means and producing a pressing action, thereby enabling the lock shafts to be independently released from the corresponding second engaging holes.

The above and other objects, characteristic features and advantages of the present invention will become more apparent from the description to be given hereinbelow with reference to the accompanying drawings.

DETAILED DESCRIPTION OF THE PREFERRED EMBODIMENTS

Now, the present invention will be described in detail below with reference to the illustrated embodiments.

The device for opening and shutting a lid according to the present invention is so constructed that a lid rotatably disposed on a console box in an automobile to be opened and shut in two directions.

Figure 1:
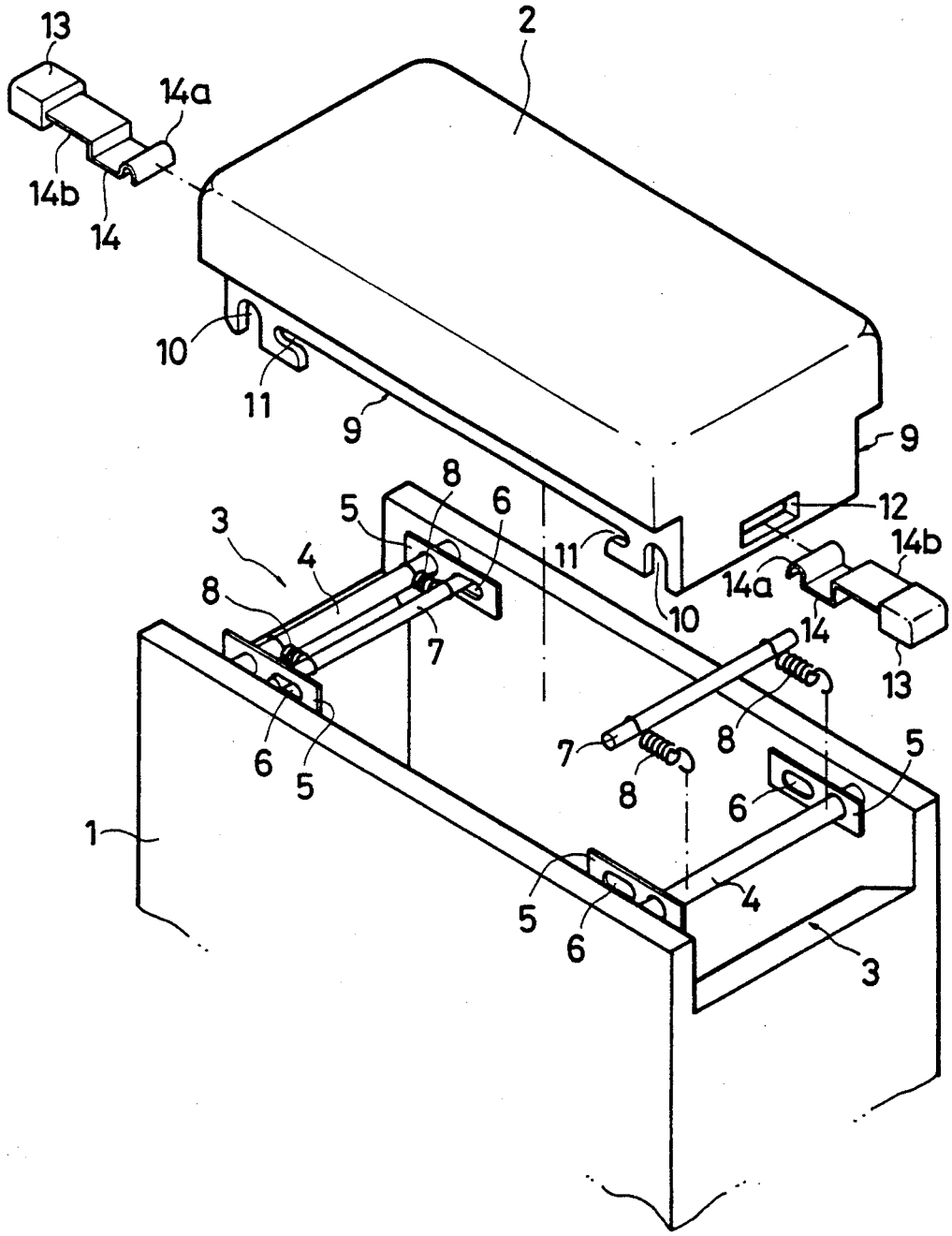
FIG. 1 is an exploded perspective view illustrating one embodiment of a device for opening and shutting a lid according to the present invention.

To be specific, as illustrated in FIG. 1, a pair of indentations 3 for admitting a lid 2 are formed one each in the opposite edges of an opening of a console box body 1, a pair of rotary shafts 4 for the lid 2 are fixed one each near the indentations 3, two pairs of brackets 5 each having an oblong guide hole 6 are rotatably disposed one bracket each in the opposite end parts of the rotary shafts 4, a pair of lock shafts 7 are so disposed that the opposite end parts thereof are idly inserted one each for reciprocation in the oblong guide holes 6 of the brackets 5, and coil springs 8 are placed so as to interconnect the lock shafts 7 with the corresponding rotary shafts 4 and consequently keep the lock shafts 7 on the opposite sides urged constantly toward the corresponding rotary shafts.

The lid is provided in the lower parts of the opposite vertical walls thereof with depressed parts 9 for admitting the brackets 5 furnished for the pair of rotary shafts 4. In each of the opposite end parts of each of the depressed parts 9, a first engaging hole of the shape of an inverted U for engagement with the rotary shaft 4 and a second engaging hole 11 of the shape of a laid U for engagement with the lock shaft 7 are independently formed. Two through holes 12 are bored one each in the opposite end walls of the lid 2. Operating buttons 13 are movably supported one each in the through holes 12.

Figure 2:
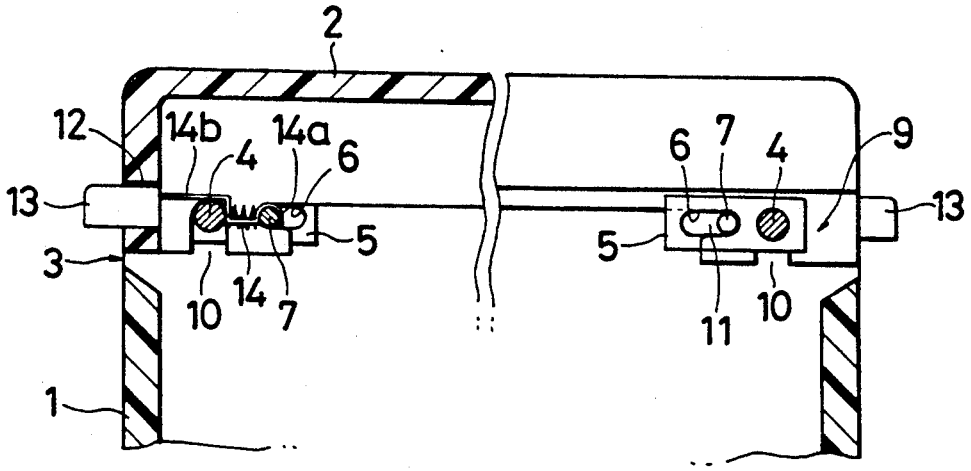
FIG. 2 is a partially cutaway cross section illustrating the state in which a lid is shut on a box body.
Figure 3:
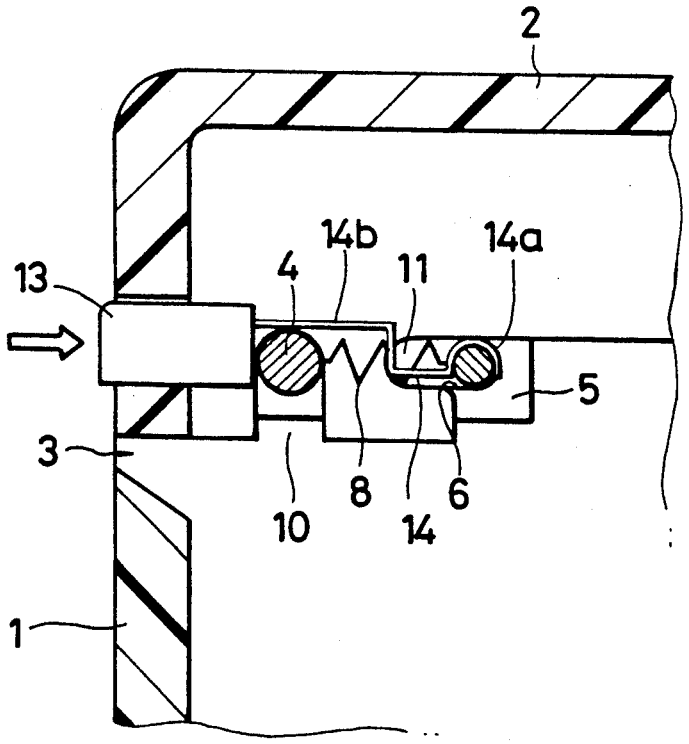
FIG. 3 is an enlarged cross section illustrating the essential part of the device in the state in which a lock shaft is released from a second engaging hole.

As illustrated in FIGS. 1 to 3, the operating buttons 13 each have a metallic pressing arm 14 integrally extending from the rear side thereof. A pressing part 14*a* of the shape of an inverted U for engagement with the lock shaft 7 is formed in the leading end part of the pressing arm 14 and a relief part 14*b* for avoiding interference with the rotary shaft 4 is formed in the basal part side thereof. When these operating buttons 13 are supported inside the through holes 12, they are kept urged outwardly inside the through holes 12 by the action of the springs 8.

When the operating buttons 13 are depressed inwardly inside the two through holes 12, therefore, the relief parts 14*b* of the pressing arms 14 act to prevent the lock shafts 7 from exerting any effect upon the rotary shafts 4 and the pressing parts 14*a* at the leading ends of the pressing arms 14 act to move the lock shafts 7 inwardly inside the oblong guide holes 6 of the brackets 5 against the resilient force of the coil springs 8.

In the opening and shutting device constructed as described above, therefore, by causing the operating buttons 13 to be supported inside the corresponding through holes 12 of the lid 2 and setting the pair of rotary shafts 4 formed on the box body 1 into engagement with the first engaging holes 10 of the shape of inverted U formed on the lid 2, the pressing parts 14*a* of the shape of inverted U of the pressing arms 14 of the operating buttons 13 come into engagement with the corresponding lock shafts 7. Consequently, as illustrated in FIG. 2, the opposite end parts of the lid 2 are locked inseparably on the box body 1 and the lid 2 is consequently enabled to give the box body 1 an infallible shut state.

Figure 4:
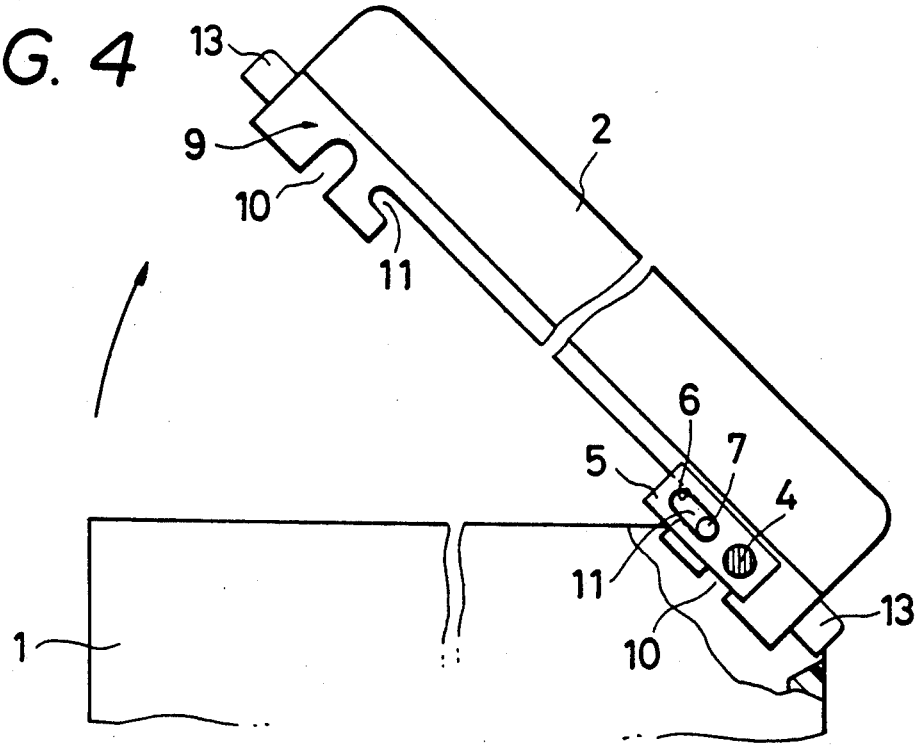
FIG. 4 is an explanatory view illustrating the state in which the lid is opened on the left side (in one direction).

Now, the opening of the lid 2 on the left side, for example, is accomplished by depressing the operating button 13 on the left side inwardly against the resilient force of the springs 8 as illustrated in FIG. 3 to release the lock shaft 7 from the second engaging hole 11 of the shape of laid U of the lid 2. As a result, the left side of the lid 2 can be immediately released from its locked state, and the lid 2 can be subsequently rotates upwardly with the rotary shaft 4 still kept in engagement with the first engaging hole 10 on the right side. Thus, the lid 2 can be easily and infallibly opened as illustrated in FIG. 4.

While the lid 2 is kept open on the left side as described above, the lid 2 is allowed to rotate smoothly and infallibly because the lock shaft 7 is kept resiliently engaged with the second engaging hole 11 on the right side and the rotary shaft 4 has absolutely no possibility of being disjoined from the first engaging hole 10 and, at the same time, the bracket 5 provided for the rotary shaft 4 is completely accommodated within the depressed part 9 of the lid 2 and rotated in concert with the rotation of the lid 2.

The shutting of the lid 2 from the open state described above is accomplished by rotating the lid 2 this time downwardly with the rotary shaft 4 kept in engagement with the first engaging hole 10 on the right side, thereby causing the pressing part 14*a* at the leading end of the pressing arm 14 of the operating button 13 to move into engagement with the lock shaft 7 and subsequently depressing the operating button 13 in the same manner as described above, thereby causing the lock shaft 7 to move inwardly inside the oblong guide holes 6 of the brackets 5 against the resilient force of the coil springs 8 and setting the lock shaft 7 into engagement with the second engaging hole 11 of the shape of laid U on the side of the lid 2. As a result, the lid 2 acquires a perfectly shut state because the lock shaft 7 is brought into resilient engagement with the second engaging hole 11 and the left side of the lid 2 is locked again.

Figure 5:
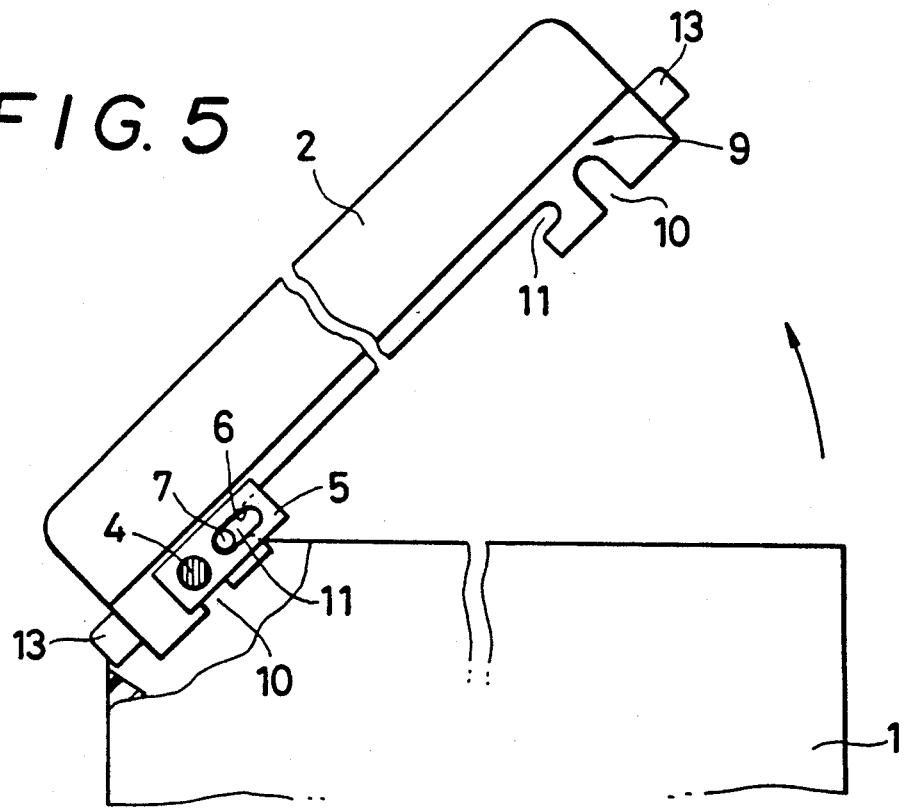
FIG. 5 is an explanatory view illustrating the state in which the lid is opened on the right side (in the opposite direction).

Conversely, the opening of the lid 2 on the right side can be accomplished by depressing the operating button 13 on the right side in the same manner as described above to release the lock shaft 7 on the same side from the second engaging hole 11 of the shape of laid U of the lid 2, thereby effecting immediate release of the right side of the lid 2 from its locked state and thereafter rotating the lid 2 upwardly with the rotary shaft 4 still kept in engagement with the first engaging hole 10 on the left side in the same manner as described above. As a result, the lid 2 can be easily and infallibly opened on the right side as illustrated in FIG. 5.

While the lid 2 is kept open on the right side, there is absolutely no possibility of the rotary shaft 4 being accidentally separated from the first engaging hole 10 because the lock shaft 7 is kept in resilient engagement with the second engaging hole 11 on the left side.

Also in this case, by rotating the open lid 2 downwardly, thereby causing the lock shaft 7 to move inwardly inside the oblong guide holes 6 of the brackets 5 against the resilient force of the coil springs 8 and consequently setting the lock shaft 7 into engagement with the second engaging hole 11 of the shape of laid U of the lid 2, the right side of the lid 2 is locked again and the lid 2 is caused to assume a perfectly shut state.

Though the embodiment described above represents the case of application of the present invention to the lid of an automobile console box, the present invention is not restricted to this embodiment but may be practised otherwise without departing from the spirit of the present invention or without reference to designation. It may be embodied, for example, in various lids and doors inclusive of refrigerator doors capable of being opened and shut in two directions.

The present invention may be otherwise embodied, though not shown specifically in the drawings, by positively forming a tapered guide surface capable of inward movement of the lock shaft on each of the lower surfaces of the component walls defining the second engaging holes, thereby enabling the lock shafts to be automatically brought into engagement with the second engaging holes by following the downward rotation of the lid.

Thus, in the construction described above, the present invention enables a lid rotatably disposed on an opening of a box body to be opened and shut in two directions by making efficient organic use of rotary shafts, lock shafts and spring means for interconnecting the two pairs of shafts. The lid is enabled to produce infallible opening and shutting motions and assume opened and shut states constantly with a click. Even when this lid is frequently opened and shut, a possibility that the lid will not be long expected to produce smooth opening and shutting actions and acquire complete opened and shut states like the conventional opening and shutting device can be absolutely avoided.

What is claimed is:

1. A device for opening and shutting in two directions a lid disposed rotatably over an opening of a box body, which comprises:

a pair of rotary shafts and a pair of lock shafts severally disposed in opposite lateral parts of the opening of the box body;

spring means interconnecting said rotary and lock shafts on the respective sides thereof and urging said lock shafts toward the corresponding rotary shafts;

opposite lateral parts of the lid having first engaging holes for engagement with said pair of rotary shafts and second engagement holes for engagement with said pair of lock shafts severally formed therein;

two pairs of brackets having oblong guide holes, each pair of brackets being rotatably disposed one bracket each on the opposite end parts of said rotary shafts, the opposite end parts of said lock shafts being idly inserted one each for reciprocation in said oblong guide holes; and a pair of operating members, one for each shaft, for causing said lock shafts to be moved away from the corresponding rotary shafts against the resilient force of said spring means and producing a pressing action, thereby enabling said lock shafts to be independently released from the corresponding second engaging holes.

2. A device according to claim 1, wherein said first engaging holes are formed in the shape of an inverted U, and said second engaging holes are formed in the shape of a horizontal U.

* * * * *